United States Patent [19]

Saito

[11] 4,264,040

[45] Apr. 28, 1981

[54] FUEL INJECTOR VALVE

[75] Inventor: Masaaki Saito, Yokosuka, Japan

[73] Assignee: Nissan Motor Company, Limited, Yokohama, Japan

[21] Appl. No.: 52,135

[22] Filed: Jun. 26, 1979

[30] Foreign Application Priority Data

Jul. 6, 1978 [JP] Japan ..... 53-81452

[51] Int. Cl.[3] ..... B05B 1/30

[52] U.S. Cl. ..... 239/585

[58] Field of Search ..... 239/585, 533; 251/139-141, 337

[56] References Cited

U.S. PATENT DOCUMENTS

| | | | |
|---|---|---|---|
| 3,241,768 | 3/1966 | Croft | 239/585 X |
| 3,721,390 | 3/1973 | Jackson | 239/585 |
| 3,731,880 | 5/1973 | Williams | 239/585 |

*Primary Examiner*—Robert B. Reeves

*Assistant Examiner*—Gene A. Church

*Attorney, Agent, or Firm*—Thompson, Birch, Gauthier & Samuels

[57] ABSTRACT

A fuel injector valve comprises a magnetic spherical valve member, a non-magnetic valve seat member on which the spherical valve member is seatable, a main magnetic pole member disposed opposite to the valve seat to attract the spherical valve member, a side magnetic pole member located spaced apart from and between the extreme end of the main magnetic pole member and the extreme end of the valve seat member, and a fuel injection section through which fuel passing through the clearance between the valve seat member and the spherical valve member is injected out of the fuel injector valve, so that the fuel injector valve is improved in response characteristics, stability and durability to provide the injector valve suitable for a so-called single point fuel injection system.

14 Claims, 8 Drawing Figures

FUEL INJECTOR VALVE

BACKGROUND OF THE INVENTION

This invention relates to an electromagnetically operated fuel injector valve, and more particular to the fuel injector valve suitable for a so-called single point fuel injection (SPI) system in which fuel injection is carried out by a fuel injector valve or fuel injector valves located at a position of an internal combustion engine.

In connection with an electronically and electromagnetically operated fuel injector valve which is controlled in response to electric pulse signals, there has been known one which is provided with an elongate valve member which is slidable in an elongate valve member guide. However, such fuel injector valve encounters the following problems: The elongate valve member and the guide member require high precision machining in order to prevent fuel leakage at the valve member/valve seat interface. Moreover, because of its elongate shape, the mass of the valve member is unavoidably increased, and this in turn adversely affects its response characteristics by high precision. In this regard, the frequency of practical vibration (opening and closing actions) of the valve member is limited to a level of 200 Hz.

Now, with the SPI system in which fuel injection is carried out only at a position, the fuel distribution to engine cylinders is inferior as compared with a fuel injection system in which a plurality of fuel injector valves are disposed for respective engine cylinders. In fuel supply in so-called on-off manner to an internal combustion engine, it is required to inject fuel at the intake stroke of each engine cylinder. Accordingly, in case of a six cylinder engine, the fuel injection must take place three times per one engine revolution and therefore the frequency in the moving action of the valve member is required to be 300 Hz at the engine speed of 6000 rpm. Similarly, the frequency in the moving action of the valve member is required to be 200 Hz at the engine speed of 6000 rpm in case of a four cylinder engine.

It will thus be appreciated that, such requirements cannot be satisfied by a fuel injector valve of an type having the elongate valve member. Hence, such a fuel injector valve is not suitable for a SPI system.

SUMMARY OF THE INVENTION

The present invention overcomes the problems encountered in conventional electronically and electromagnetically operated fuel injector valves and thus provides a fuel injector valve which satisfies the requirements of an SPI fuel injection system, by reducing the weight of the movable valve member and by arranging the location of the magnetic poles in a manner such that the magnetic field produced more effectively acts on the valve member.

It is the prime object of the present invention to provide an improved fuel injector valve which is excellent in response characteristics, stability and durability, as compared with various conventional fuel injector valves.

It is another object of the present invention to provide an improved fuel injector valve in which the movable valve member is relatively small and spherical, which in turn makes it lighter and easier to machine as compared with the elongate valve members of conventional valve designs.

It is a further object of the present invention to provide an improved fuel injector valve in which a side magnetic pole concentrating the magnetic force of a main magnetic pole thereon is located in close proximity to the surface of a spherical valve member so that the magnetic force can act more effectively on the spherical valve member.

It is a still further object of the present invention to provide an improved fuel injector valve in which a pressure differential is generated between the upstream and downstream sides relative to a spherical valve member and therefore the force to bias the valve member toward a valve seat is generated whenever the fuel flows through the clearance between the valve member and the valve seat member, by which a spring for biasing the valve member to the valve seat member may be omitted.

These and other objects, features and advantages of the fuel injector valve according to the present invention will be more apparent from the following description when taken in conjunction with the accompanying drawings in which the like reference numerals are assigned to the like parts and elements throughout all figures.

DESCRIPTION OF THE PREFERRED EMBODIMENTS

Figure 1:
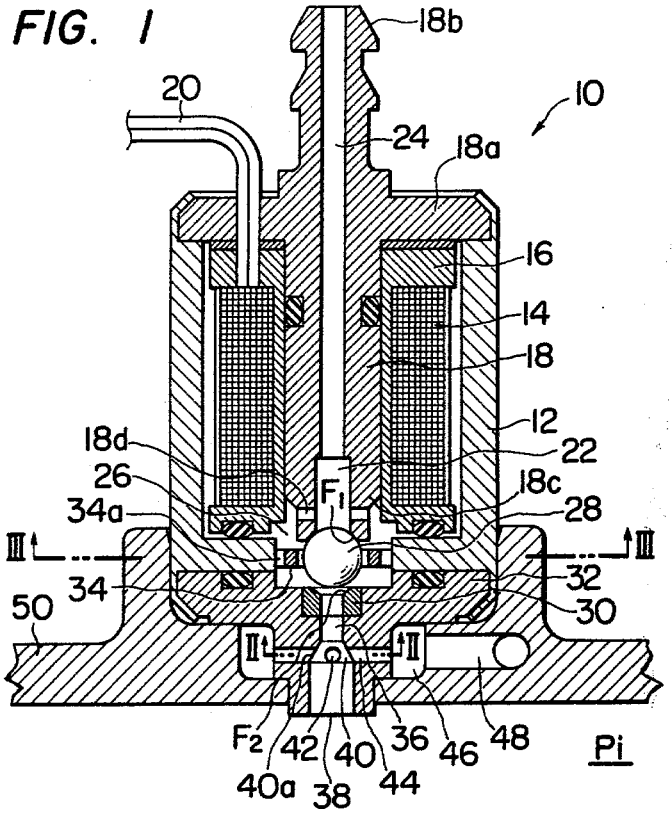
FIG. 1 is a vertical cross-sectional view of an embodiment of a fuel injector valve in accordance with the present invention.

Referring now to FIGS. 1 to 4 inclusive of the drawings, there is shown a preferred embodiment of a fuel injector valve 10 in accordance with the present invention, which is usable in a SPI system for an internal combustion engine, though not shown. The fuel injector valve 10 comprises a casing 12 in which an electromagnetic coil 14 is disposed through a bobbin 16 around an electromagnetic core 18. The reference numeral 20 represents a lead wire for passing electric current through the coil 14. The core 18 is integrally formed with a flange portion **18*a* secured to the top section of the casing 12, and a fuel inlet pipe portion 18*b*. The core 18 is formed at its tip portion 18*c* with a cylindrical bore 22 forming part of a fluid inlet passage 24 for introducing fuel into a fuel chamber 26 under pressure. The bore 22 communicates with the fuel chamber 26 through a plurality of openings 18***d* which are radially outwardly formed through the cylindrical wall of the tip portion 18*c* of the core 18.

A spherical valve member 28 made of magnetic material is movably disposed within the fuel chamber 26 and located to be attracted to a valve contact surface $F_1$ formed at the tip portion of the core 18 when the core 18 is energized. Accordingly, the tip portion 18*a* of the core 18 serves as a main magnetic pole for magnetically attracting the spherical valve member 28 thereto. The spherical valve member 28 is seatable on a valve contact surface $F_2$ formed at a valve seat member 30 which is embedded into a base member 32 secured to the bottom section of the casing 12. The valve seat member 30 is of the cylindrical shape and formed with a cylindrical opening (no numeral) along the axis of the valve seat member 30. It is to be noted that the axis of the valve seat member 30 is aligned with that of the magnetic core 18 which is arranged vertical in this case. Accordingly, the contact surfaces $F_1$ and $F_2$ are opposite to each other so that the spherical valve member 28 is movable or able to vibrate between the contact surfaces $F_1$ and $F_2$ by repetition of the energization and de-energization of the electromagnetic core 18. Each of the valve contact surfaces $F_1$ and $F_2$ is formed into the conical or spherical shape, and accordingly the contact surfaces $F_1$ and $F_2$ function to rightly locate the spherical valve member 28 at required positions and to restrict the movement of the valve member 28 in the lateral direction or right and left in the drawing.

A disc-type annular member 34 made of magnetic material is in close proximity to the surface of the valve member 28 in such a manner that the inner periphery of the annular member surrounds and is spaced apart from the surface of the valve member 28. It is to be noted that a closed magnetic field is formed between the main magnetic pole 18*c* and the annular member 34 as indicated by the lines a of magnetic force in FIG. 2, and therefore the annular member 34 serves as a side magnetic pole which receives the lines of the magnetic force leaving from the main magnetic pole 18*c*. The annular member 34 is secured to or formed integrally with casing 12, and provided with a plurality of through-holes 34*a* through which the fuel at the main magnetic side flows into the valve seat member side. As seen from FIG. 2, the side magnetic pole 34 is located spaced apart from and between the level of the extreme end of the main magnetic pole 18*c* and the extreme end of the valve seat member 30. It is preferable to locate the side magnetic pole 34 as near as possible the valve member within a range that the valve member 28 never contacts the side magnetic pole 34 even during the lateral vibration of the valve member 28. It will be understood that, as the side magnetic pole member 34 is closer to the spherical valve member 28, the concentration of the magnetic flux on the side magnetic pole 34 becomes stronger and therefore the action of the lines a of magnetic force on the valve member 28 becomes greater.

A fuel injection section (no numeral) is formed in the base member 32, and includes a fuel passage 36 which is in communication with the cylindrical opening of the valve seat member 30. The fuel passage 36 is in communication with a fuel injection opening 38 through a mixing chamber 40 in which the fuel is mixed with air. The mixing chamber 40 is defined by a conical or inclined side wall 40*a* through which a plurality of openings 42 are formed. The openings 42 communicate through air passages 44 with an air chamber 46 to which air is introduced under pressure through an air introduction passage 48 which is in communication with an air source (not shown). It will be understood that air is ejected through the openings 42 into the fuel to be injected from fuel injection opening 38. It is preferable to arrange the air passages 44 such that the axes thereof lie in the directions of tangent lines of the inclined side wall 40*a* as viewed in FIG. 3. The thus arranged fuel injector valve 10 is secured to the wall member 50 defining an intake passageway $P_i$ through which intake air is inducted into the combustion chambers (not shown) of the engine so that the fuel injection opening 38 lies to inject fuel into the intake passageway $P_i$.

The operation of the thus arranged fuel injector valve 10 will now be explained thereinafter.

When electric current is not passed through the electromagnetic coil 14 and the tip portion 18*c* of the electromagnetic core 18 or the main magnetic pole is de-energized, magnetic force does not act on the spherical valve member 28 so that the valve member 28 is forced downward in the drawing by the pressure of the fluid admitted into the fluid chamber 26. Accordingly, the spherical valve member 28 is securely seated on the contact surface $F_2$ of the valve seat member 30 as indicated in phantom $V_1$ in FIG. 2. As a result, the fuel flow through the clearance between the surface of the spherical valve member 28 and the contact surface $F_2$ of the valve seat member 30 does not take place to stop the fuel injection through the fuel injection opening 38.

Figure 2:
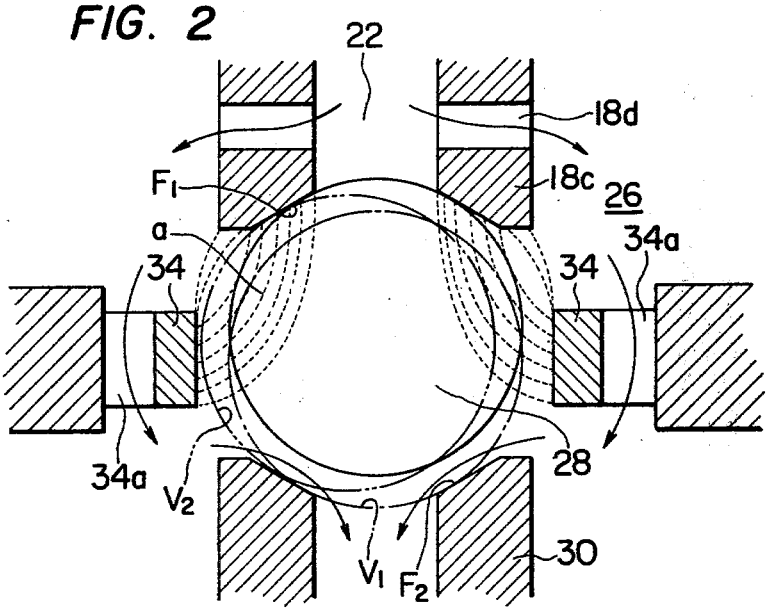
FIG. 2 is an enlarged fragmentary section of the injector valve of FIG. 1, showing an essential part of the fuel injector valve.
Figure 3:
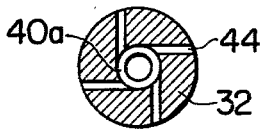
FIG. 3 is a transverse section taken in the direction of the arrows substantially along the line II—II of FIG. 1.
Figure 4:
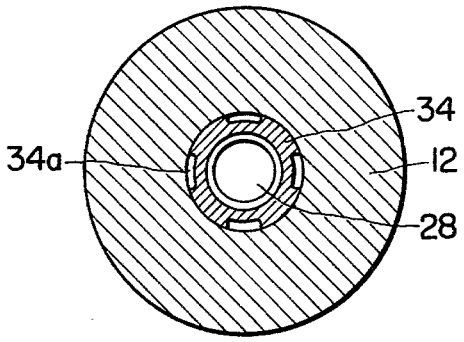
FIG. 4 is a transverse section taken in the direction of the arrows substantially along the line III—III of FIG. 1.

On the contrary, when electric current is passed through the electromagnetic coil 18 to energize the main magnetic core 18*c*, magnetic force of the main magnetic pole 18*c* is concentrated on the annular member 34 of the side magnetic pole as indicated by the lines a of magnetic force in FIG. 2 so that the magnetic force effectively acts on the spherical valve member 28. Accordingly, the valve member 28 securely contacts or is seated on the contact surface $F_1$ of the main magnetic pole 18*c* as shown by solid line in FIG. 2. Then, the fuel admitted to the cylindrical bore 26 is introduced to the clearance between the valve member 28 and the valve seat member 30 mainly through the openings 18*d* of the main magnetic pole 18*c* and the through-holes 34*a* of the side magnetic pole 34, in which the fuel flows apart from the spherical valve member 28. The fuel passed through the clearance between the valve member 28 and the valve seat member 30 is introduced to the fuel passage 36, and then the fuel is mixed with air introduced through the openings 42 in the mixing chamber 40. The mixture of the fuel and air is injected through the injection opening 38 into the intake air passageway $P_i$. It is preferable to form sufficiently large the cross-sectional areas of the openings 18*d* of the main magnetic pole 18*c* and the through-holes 34*a* of the side magnetic pole 34 as compared with that of the clearance defined between the spherical valve member 28 and the side magnetic pole 34, in order that fuel flow scarcely occurs through the clearance between the valve member 28 and the side magnetic pole 34.

In this regard, if the side magnetic pole 34 is not provided with the through-holes 34*a*, the fuel flows along the surface of the spherical valve member 32. However, the fuel flow on the spherical surface of the valve member 32 is not uniform at all side surface portions of the spherical valve member 28, and therefore lower pressure is generated at a side surface portion on which the flow speed of the fuel is higher than the other side surface portions, by so-called Coanda effect. As a result, a pressure differential is generated, for example, between the right and left side surface portions of the valve member 28 in the drawing, so that the valve member 28 is inclined in the lateral direction in the drawing, for example, as indicated in phantom $V_2$ in FIG. 2. When such inclination of the valve member 28 occurs, the flow speed of the fuel increases on the other side surface portion which is opposite to the side surface portion closest to the side magnetic pole 34. Accordingly, the pressure on the said other side surface portion lowers to generate pressure differential between the both side surface portions of the valve member 28, so that the said other side surface portion of the valve member 28 approaches the side magnetic pole 34 to incline the valve member 28 in the opposite direction of the phantom $V_2$. By the repetion of such inclinations of the valve member 28, the valve member 28 may be vibrated in the right and left in the drawing, which deteriorates the smooth and stable opening and closing actions of the valve member 28. It will be appreciated from the foregoing discussion, that the through-holes 34*a* of the side magnetic pole 34 are advantageous for the operation of the electromagnetic injector valve of the type using a spherical valve member.

It will be understood that although the openings 18*d* of the main magnetic pole 18*c* functions the same as the through-holes 34*a* of the side magnetic pole 34, the openings 18*d* are less effective in decreasing effect to inclination of the valve member 28 than the through-holes 34*a* of the side magnetic pole 34 since the openings 18*d* are located at the main magnetic pole side.

Figure 5A:
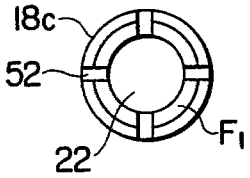
FIG. 5A is a bottom plan view of an example of a main magnetic pole used in the fuel injector valve of FIG. 1.
Figure 5B:
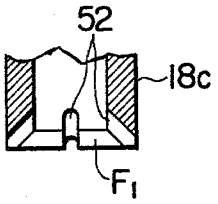
FIG. 5B is a vertical section of the main magnetic pole of FIG. 5A.

In this connection, as shown in FIGS. 5A and 5B, the openings 18*d* of the main magnetic pole 18*c* are replaced with one or more grooves 52 formed at the contact surface $F_1$ of the main magnetic pole 18*c*. Each groove 52 is formed radially and outwardly to communicate the bore 22 of the main magnetic pole 18*c* with the fuel chamber 26 even when the spherical valve member 28 securely contacts or be seated on the contact surface $F_1$ of the main magnetic pole 18*c*.

With this arrangement, the fuel flow through the groove 52 facilitates separation of the valve member 28 from the contact surface $F_1$ of the main magnetic pole 18*c* at the beginning of the closing action of the valve member 28 at which the valve member 28 starts to separate from the contact surface $F_1$. Additionally, the same fuel flow can remove a disadvantageous damping action to the valve member 28 which action occurs when the valve member 28 contacts or is seated on the contact surface $F_1$ at the end of the opening action of the valve member 28. Such damping action is caused by existence of fluid between the surface of the valve member 28 and the contact surface $F_1$ of the main magnetic pole 18*c*. Such advantageous effects of the groove 52 seem to be assisted by a fact that the spherical valve member 28 is vibrated by the action of the fuel flow through the groove 52.

Figure 6:
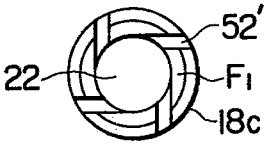
FIG. 6 is a bottom plan view similar to FIG. 5A, but showing another example of the main magnetic pole.

Furthermore, as shown in FIG. 6, each groove 52' can be arranged in the direction of a tangent line relative to the inner periphery of the contact surface $F_1$ of the main magnetic pole 18*c*. With this arrangement, the fuel flowing through the grooves 52' causes rotation of the spherical valve member 28 and therefore the local abrasion of the valve member 28 and the contact surfaces $F_1$, $F_2$ can be effectively prevented.

At the valve opening state, a higher speed fuel flow is generated between the contact surface $F_1$ and the surface of the spherical valve member 28, which produces the pressure differential between the upstream and downstream sides of the valve member 28. This pressure differential causes force which biases the valve member 28 toward the contact surface $F_2$ of the valve seat member. The thus caused biasing force can bias the valve member 28 to be seated on the contact surface $F_2$ of the valve member in cooperation with a downward force due to the pressure of the fuel flow.

It will be understood that when the high speed fuel flow passes through the mixing chamber 40, a low pressure spot is produced in the mixing chamber 40. The air can be effectively inducted in the mixing chamber 40 by virtue of the low pressure spot. Then, the fuel is injected in a straight line through the air injection opening 38 into the intake passageway, concurrently with sucking of air supplied through the air passages 44. Now, as appreciated, the low pressure generated adjacent the surface of mixing chamber wall 40*a* is not uniform. Therefore, if the abovementioned air induction to the mixing chamber 40 does not takes place, the fuel flow passing through the mixing chamber 40 is drawn toward a low pressure portion by the Coanda effect and therefore the fuel injection direction is unavoidably inclined. Moreover, due to the abovementioned arrangement in which the axes of the air passages 44 lie in the directions of tangent lines relative to the inclined surface of the mixing chamber wall 40*a*, mixing of air and fuel is further improved, and additionally atomization of the fuel is improved since the rotational movement is applied to the fuel flow passing through the mixing chamber 40 so that fuel to be injected can be rotated as a swirl.

Figure 7:
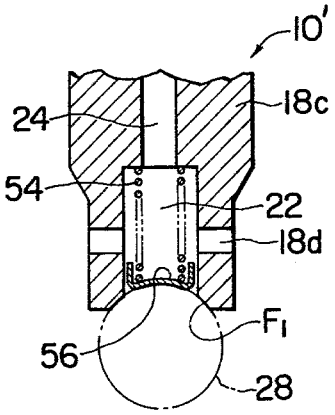
FIG. 7 is a fragmentary vertical section of another embodiment of the fuel injector valve, showing an essential part of the fuel injector valve.

FIG. 7 illustrates an essential part of another embodiment of the fuel injector valve 10', in which a spring 54 is disposed in the cylindrical bore 22 formed at the tip portion 18*c* or the main magnetic pole. The spring 22 contacts through a spring retainer 56 to the surface of the spherical valve member 28. The spring 34 functions to bias the valve member 28 downward in the drawing or in the direction of the valve seat member (not shown).

Now, it may occur that so-called residual magnetism is retained in the main magnetic pole 18*c* even if the electromagnetic coil 14 is de-energized. In this case, it is necessary to bias the spherical valve member 28 overcoming the force of the residual magnetism, in order to seat the valve member 28 onto the valve seat member 30 (not shown). If the spring 54 is not used in such a case, the biasing force to the valve member 28 only due to the fuel pressure may be insufficient, particularly when the fuel pressure is relatively low by which there is a fear that the valve member 28 separates from the valve seat member to cause fuel leak. Hence, it is appreciated that the spring 54 is advantageous in the above-mentioned particular cases.

It is preferable that the spring 54 and the spring retainer 56 are made of non-magnetic material such as plastics, brass, stainless steel etc. In this regard, if the spring 54 and the spring retainer 56 are made of magnetic material, the magnetic field is disturbed to unnecessarily vibrate the valve member 28 in right and left in the drawing, which vibration is greatly assisted by slight uneveness distribution of the spring force of the spring 54. It will be understood that the spring retainer 56 also largely contributes to stable opening and closing actions of the valve member 28.

It is to be noted that since the cylindrical bore 22 and the fuel inlet passage 24 have been shown and described as formed through the electromagnetic core 18 throughout all the embodiments, the fuel injector valve 10 or 10' can be rendered compact, easily installed to the engine and easily piped in a fuel piping system.

As appreciated from the above discussion, according to the present invention, since the movable valve member 28 is made spherical, the response time in the opening and closing actions of the valve member is shortened to improve the response characteristics of the fuel injector valve. Additionally, the spherical valve member does not require an elongate valve member guide section on which the valve member is slidable, and therefore the precise machining for the guide section is omitted. Besides, since the side magnetic pole is located as near as possible the valve member within a range that the valve member does not contact with the side magnetic pole, the magnetic force can effectively act on the spherical valve member, which also largely contributes to the improvement in the response characteristics of the fuel injector valve. The fuel injector valve in accordance with the present invention can be operated at high frequency in the opening closing actions of the valve member to cause excellent response characteristics and durability even in the SPI system, satisfying the requirements of the internal combustion engine equipped with the SPI system.

What is claimed is:

1. A fuel injector valve comprising:

means defining a fuel chamber;

fuel inlet means for introducing fuel into said chamber;

an outlet through which fuel exits from said chamber;

a non-magnetic valve seat surrounding said outlet;

a main magnetic pole member having one end spaced from and opposed to said valve seat;

a side magnetic pole member surrounding the space between said valve seat and the end of said main magnetic pole member;

a magnetic spherical valve member located in said space, said valve member being movable between an open position spaced from said valve seat by a first clearance and in contact with the end of said main magnetic pole member when said main magnetic pole member is magnetically energized, and a closed position spaced from the end of said main magnetic pole member and in contact with said valve seat when said main magnetic pole member is magnetically de-energized and said valve member is acted upon by fuel in said chamber; and, guide means associated with said valve seat and the end of said main magnetic pole member for maintaining a second clearance between said valve member and said side magnetic pole member.

2. The fuel injector valve of claim 1 wherein said guide means comprises opposed guide surfaces located respectively on said valve seat and the end of said main magnetic pole member.

3. A fuel injector valve as claimed in claim 1 wherein said main magnetic pole member is cylindrical and said fuel inlet means includes an inlet passageway extending axially therethrough.

4. The fuel injector valve of claim 3 further comprising intermediate passageway means for accommodating a flow of fuel from said inlet passageway to said first clearance while bypassing said second clearance.

5. The fuel injector valve of claim 4 wherein said non-magnetic valve seat is cylindrical and aligned axially with said main magnetic pole member.

6. The fuel injector valve of claim 5 wherein said guide means comprises opposed guide surfaces located respectively on said valve seat and the said one end of said main magnetic pole member, said opposed guide surfaces being positioned to maintain said second clearance by coacting in engagement with said spherical valve member.

7. The fuel injector valve of claim 6 wherein said opposed guide surfaces are conically shaped.

8. The fuel injector valve of claim 6 wherein said opposed guide surfaces are spherically concave.

9. The fuel injector valve of claim 6 wherein said magnetic side pole member has an annular shape and protrudes radially inwardly into said fuel chamber, and wherein said intermediate passageway means consists of first openings connecting said inlet passageway to said fuel chamber, and second openings extending through said magnetic side pole members at locations spaced radially from said second clearance.

10. The fuel injector valve of claim 5 wherein said valve seat connects said fuel chamber to a fuel mixing chamber, and air inlet means for introducing air into said fuel mixing chamber.

11. The fuel injector valve of claim 10 wherein said fuel mixing chamber is cylindrical and aligned axially with said valve seat, and wherein said air inlet means comprises air passageways communicating with said fuel mixing chamber tangentially to the wall thereof.

12. The fuel injector valve of claim 6 wherein the guide surface on the said one end of said magnetic pole member is formed with a plurality of grooves through which said inlet passageway is allowed to communicate with said fuel chamber when said spherical valve member is in the open position and in contact with said guide surface.

13. The fuel injector valve of claim 12 wherein said grooves are arranged tangentially in relation to the wall of said inlet passageway.

14. The fuel injector valve of claim 3 further comprising spring means disposed in said inlet passageway for biasing said spherical valve member towards said valve seat, said spring means being physically separated from said spherical valve member by a spring retainer member positioned therebetween.

* * * * *